United States Patent [19]

Wiggins

[11] 3,937,180

[45] Feb. 10, 1976

[54] APPARATUS FOR ELECTROSTATICALLY CHARGING WORKPIECES FOR SPRAY COATING APPLICATION

[75] Inventor: Richard F. Wiggins, Fairfield, Conn.

[73] Assignee: The Gyromat Corporation, Stratford, Conn.

[22] Filed: Apr. 10, 1974

[21] Appl. No.: 459,470

[52] U.S. Cl. ..... 118/635; 118/630

[51] Int. Cl.[2] ..... B05B 5/02

[58] Field of Search ..... 118/635, 625, 630; 117/93.4 R; 427/12, 27, 33

[56] References Cited

UNITED STATES PATENTS

| | | | |
|---|---|---|---|
| 2,553,724 | 5/1951 | Ransburg | 118/635 |
| 2,655,128 | 10/1953 | Ransburg | 118/635 |
| 2,805,642 | 9/1957 | Tuttle et al. | 118/635 |
| 3,113,037 | 12/1963 | Watanabe | 118/635 |
| 3,376,156 | 4/1968 | Whitaker et al. | 118/635 |

*Primary Examiner*—Mervin Stein
*Assistant Examiner*—Douglas Salser
*Attorney, Agent, or Firm*—Mandeville and Schweitzer

[57] ABSTRACT

Disclosed herein are a method and apparatus for progressively charging an electrically isolated conductive workpiece from ground potential to high potential while the workpiece is supported by a moving grounded conveyor. A portion of the conveyor is selectively included in circuit with a high voltage source and a voltage divider to charge the isolated conveyed workpieces to high electrostatic potential with respect to ground. The highly charged workpieces are conveyed past a grounded spray device dispersing atomized particles (i.e., liquid or powder) which are at electrical ground potential. In accordance with well known electrostatic coating principles, the particles will be attracted to the high potential workpiece parts and will adhere thereto. As a more specific aspect of the invention, the high potential is applied to the workpieces through a unique "brush and commutator" apparatus which sequentially and gradually increases the charging of the workpiece from ground potential to a predetermined desired level for electrostatic spray deposition in a spray zone and thereafter sequentially gradually decreases the charge on the workpiece to ground potential after exiting the spray zone.

4 Claims, 5 Drawing Figures

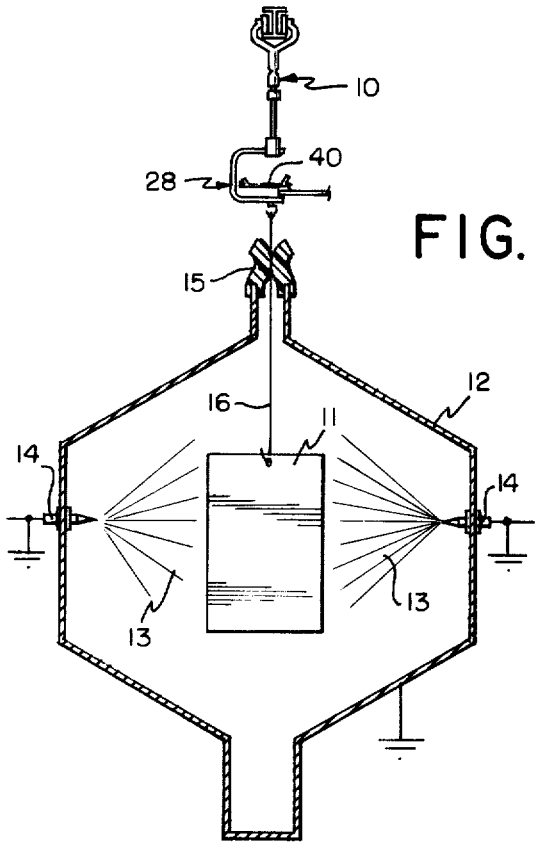
FIG. 1
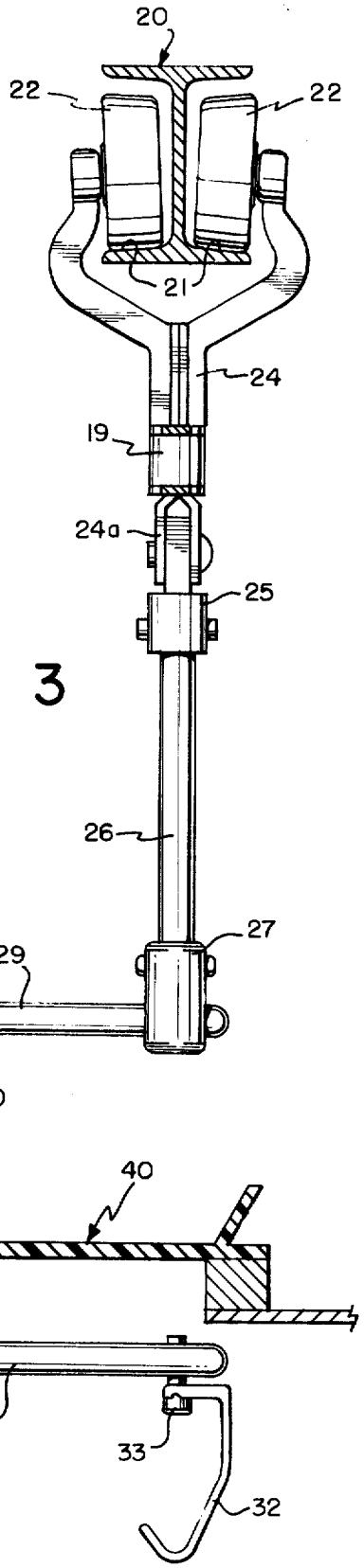
FIG. 3
FIG. 4
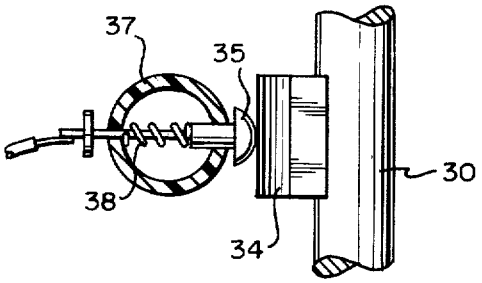

APPARATUS FOR ELECTROSTATICALLY CHARGING WORKPIECES FOR SPRAY COATING APPLICATION

BACKGROUND OF THE INVENTION

Electrostatic coating processes are part of a highly sophisticated and well developed art, in typical embodiments of which atomized, highly charged coating materials are sprayed upon grounded workpieces. The difference in charge or in electrical potential between the spray particles and the grounded workpieces results in a highly efficient deposition of coating material on the workpieces and promotes the complete coating of intricate surfaces by "wrap around," the phenomenon by which a traveling particle may be propelled initially by the spray device beyond a surface of a workpiece and yet be attracted thereto and deposited thereon after a change in direction by virtue of the electrostatic forces. Conventionally, the workpiece is grounded to form one electrode in the electrostatic system and the paint particles are energized to high electrical potential by a separate charging electrode. However, in certain specialized applications, it is impracticable to use the spraying device as the charging electrode, or it is otherwise desirable and advantageous to employ uncharged conventional spray guns while achieving the benefits of electrostatic coating.

SUMMARY OF THE PRESENT INVENTION

To that end, in accordance with the principles of the present invention, a workpiece to be coated is provided with a high charge (negative or positive) as it is conveyed through a spray coating station in which atomized spray particles, at ground potential, are directed thereat by conventional, nonelectrostatic spray guns or devices. Such guns or devices disperse coating particles by well known techniques. By charging the workpiece and using non-charged spray devices, the handling of many important and advantageous coating materials (e.g., water based or other highly conductive coatings) is vastly simplified and made comparatively more safe to operating personnel than in the cases where charged spray devices are used in the electrostatic deposition of coatings on grounded workpieces. Thus, it will be appreciated that the use of the appartus of the invention for charging workpieces, while employing conventional spray guns at ground potential, enables electrostatic deposition techniques to be employed in environments that were heretofore hostile to or otherwise not well suited for electrostatic deposition by conventional charged gun techniques. Representative of such a new and beneficial application is the employment of the new apparatus in conjunction with a paint spray system of the type described in U.S. Pat. No. 2,848,353 and currently commercially available as the so-called "Liquid Seal" system from The Gyromat Corporation, Stratford, Connecticut. Heretofore, the advantageous use of "Liquid Seal" systems has been restricted to non-electrostatic deposition, and, of course, such systems have not benefited from the advantages obtained from electrostatic deposition of coatings.

More specifically, in accordance with the principles of the present invention, a conductive workpiece to be coated is supported and conveyed through a spray painting zone by specially constructed or otherwise specially modified conveying apparatus which is adapted to selectively and sequentially charge a conveyed workpiece to provide the workpiece with a progressively increasing charge as it approaches the spray zone. The new apparatus is further adapted to maintain a predetermined maximum charge on the workpiece throughout the spray zone, and thereafter to sequentially and successively, progressively reduce the charge of the workpiece to ground potential. The conveyor structure itself is maintained at ground potential with the limited exception of the selected article-supporting means, e.g. isolated hooks for top supported work or isolated rollers for bottom supported work, which enter, pass through, and exit from the spray zone. Therefore, it is to be understood that, while one preferred form of the invention, the form to be described hereinafter, is in the nature of an overhead type of conveyor, the inventive concepts may be applied with similar efficacy to other types of conveyors, such as bottom supporting roller or slat conveyors having discrete article supporting elements.

For a more complete understanding of the principles of the present invention and a better appreciation of all of its attendant advantages, reference should be made to the following detailed description of a preferred embodiment of the invention taken in conjunction with the accompanying drawings.

DESCRIPTION OF THE DRAWINGS

FIG. 1 is a schematic representation of a paint spraying installation including a "liquid seal" chamber through which a charged workpiece is conveyed by an overhead conveyor apparatus embodying the principles of the present invention;

FIG. 3 is an enlarged, side elevational view of a "sanitary" conveyor hook embodying the principles of the present invention;

FIG. 4 is a further enlarged, fragmentary, elevational view of the commutator apparatus of the present invention.

DETAILED DESCRIPTION OF THE PRESENT INVENTION

Figure 2:
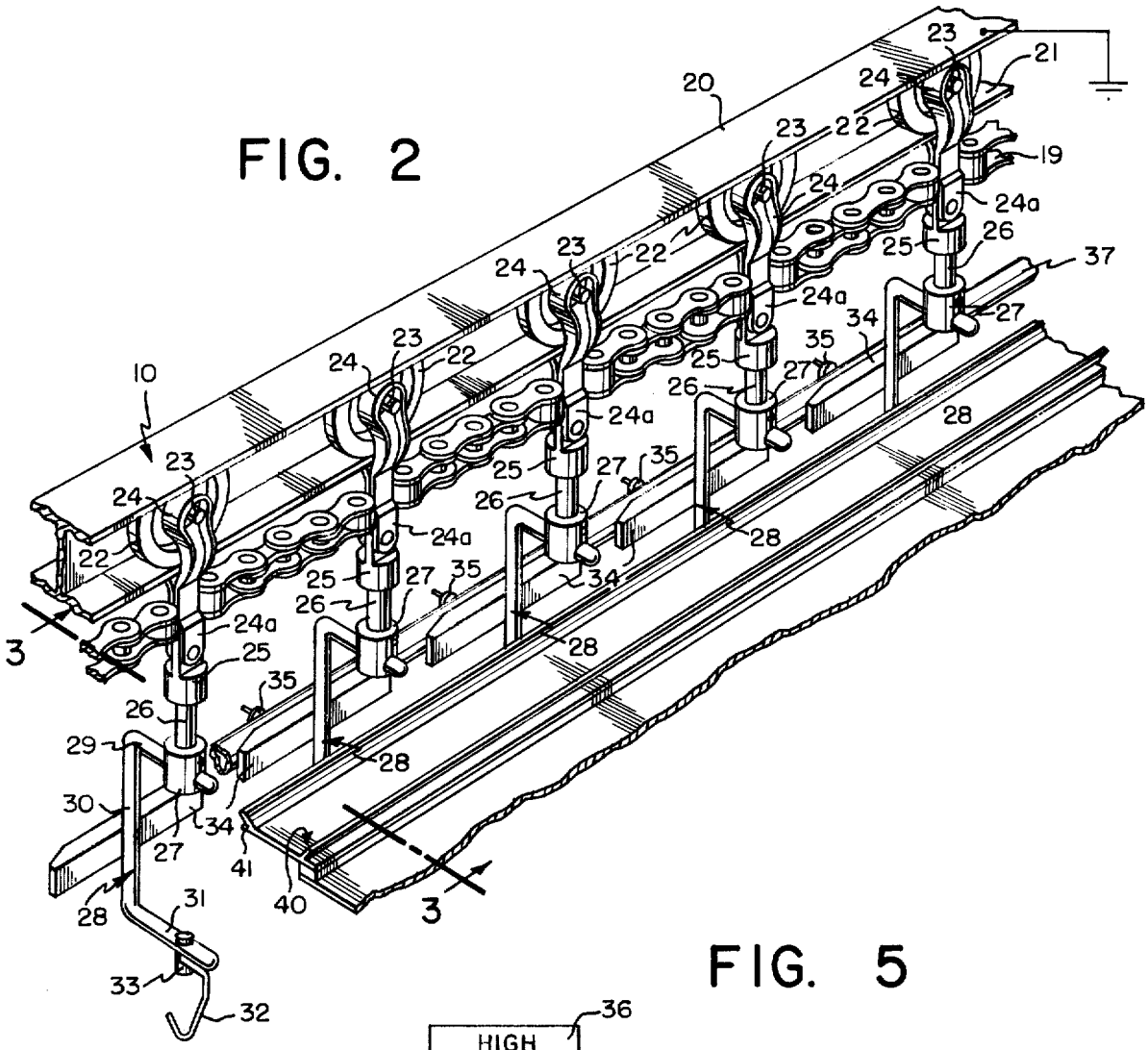
FIG. 2 is a fragmentary, perspective view of an overhead conveyor including a horizontal track and suspended workpiece supporting hooks.

Referring initially to FIG. 1, the apparatus and method of the present invention are most advantageously employed in conjunction with a paint spraying line in which a traveling conveyor 10 conveys workpieces 11 through a paint spray chamber 12 in which the workpiece is coated with atomized spray 13 issued from grounded spray guns 14. In the illustrated embodiment, which is exemplary, the conveyor 10 is of the "overhead" type and the supporting elements are discrete hangers 28. Conductive extension hooks 16 extend through an insulated slot 15 in the chamber 12 for suspending workpieces. The principles of the invention may be used to equal advantage in bottom supporting conveyors having discrete rollers, slats, bars, or the like, as will be understood. The guns or spray devices 14 may be of any conventional and well known configuration. The essential criterion for the practice of the present invention is that the guns be maintained at ground potential and that the sprays issuing from the guns, regardless of the means by which they are formed or atomized, be at ground potential relative to the highly charged or highly elevated potential (which is advantageously but not necessarily negative) of the workpiece 11 upon which the atomized spray particles 13 are deposited.

Referring now to FIG. 2, the conveyor 10 of the illustrated embodiment of the present invention is in the form of an overhead type of conveyor including a horizontal track or rail 20 having an I-beam shaped cross section. The lower flanges 21 of the rail support an opposed pair of rollers or wheels 22 supported on axles 23 which are in yoke-like support members 24, the lower bracketed ends 24*a* of which support cap assemblies 25. In accordance with the invention, a non-conductive, isolating member 26 may be in the form of an epoxy glass filled rod (or any heat resistant dielectric material, e.g., glass, ceramic, etc.) of approximately 6 inches in length, which rod is highly heat resistant, is supported at its upper end by the cap assembly 25 and at its lower end supports a lower end cap 27, which, in turn, mounts a conductive hanger member 28. The hanger element 28 may be of any suitable configuration for use with an overhead conveyor and is illustrated herein, by way of example, as being C-shaped, although other hook shapes or hook supporting shapes may be used. The illustrated C-shaped hanger member 28 is a so-called "sanitary" hanger and includes a vertical leg 30 joining an upper horizontal leg 29 (which passes through the lower cap 27 and is fastened thereto by a rivet or other appropriate means) to a lower horizontal leg 31, from the free end of which depends an auxiliary article support hook 32. The hook 32 suspends from the C-shaped hanger member 28 through a swivel pin assembly 33 in known fashion.

In accordance with the invention, a horizontal elongated electrical brush or shoe member 34, formed of resilient conductive material, of sufficient length to contact adjacent pairs of spring loaded commutator elements 35, is rigidly fixed to the hanger element. The commutator elements 35 are flexibly or resiliently supported in an elongated hollow tube 37 formed of a non-conductive or insulated material and are biased toward the brushes 34 by coil springs 38. Alternatively, the commutator elements 35 may be rigidly mounted and the shoe member may be spring loaded or otherwise be resilient with respect to the elements 35. In either case, the elements 35 represent terminals of a high voltage source power supply, indicated schematically at 36 in FIG. 5, and all of the commutators 35 are mounted at a predetermined center-to-center spacing (slightly less than the length of the brushes 34).

Figure 5:
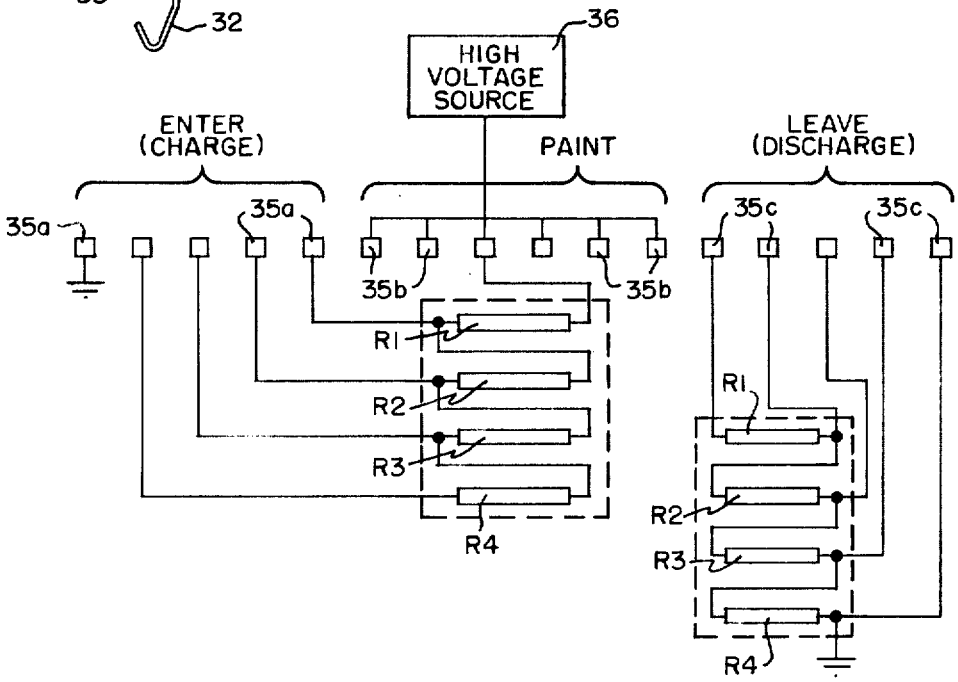
FIG. 5 is a schematic view illustrative of the high potential charging cycle of the apparatus of the present invention.

Thus, as the individual conveyor hanger elements 28 are driven at a predetermined rate along the conveyor path by appropriate drive means, such as the roller chain 19 shown in FIG. 2, the brush or shoe 34 will consecutively and successively be in continuous "make before break" contact with the first group of commutator elements 35*a*; the second group of commutator elements 35*b* during the actual painting of the workpiece 11; and finally the last group of commutator elements 35*c*, as the workpiece exits the painting zone. More specifically and as indicated in FIG. 5, as the hanger element and its associated brush traverse the initial commutator elements 35*a*, the workpiece 11 is successively exposed to greater and greater voltage from the high voltage source which is connected directly to the part through the contacts 34, 35, and the conductive C-shaped hanger element 28 and the conductive hook 32 through less and less resistance. That is to say, initially, as the conveyor contacts the first of the series of commutators 35*a*, the workpiece 11 will be at ground potential, since the first contact is at ground potential; the next contact 35 applies a potential in the form of the high potential which has been reduced by the inclusion of resistors R1, R2, R3, and R4 (approximately 300 megohms each) in series therewith. Thereafter, as the conductor brush 34 continues to traverse the initial contacts 35*a*, resistance R3, R2, and R1 are consecutively removed from the energizing circuit until the workpiece is charged with the maximum high voltage as it traverses the painting zone, and the brush 34 passes over the commutator contacts 35*b*. Lastly, in accordance with the invention, the charged and now coated workpiece 11 is progressively uncharged as the conductor brush 34 traverses the last group of commutator elements 35*c*. Through this region, the high voltage is initially discharged to ground through a maximum resistance comprising resistances R1, R2, R3, and R4 and then progressively through fewer resistances until at the final commutator contact 35*c*, the workpiece is grounded by connection directly to ground.

With the above-described "make before break" switching actions effected as the series of contacts 35 is traversed by each brush, the workpiece 11 is continuously energized with a gradually increasing voltage until a predetermined maximum voltage is achieved, which maximum voltage is continuously maintained throughout the application or deposition of spray particles on the workpiece and which is thereafter continuously and gradually decreasingly uncharged until the workpiece is again at ground potential. This arrangement tends to prevent arcing when workpieces of large mass are charged and coated and provides a reliable, efficient and safe means of charging workpiece in a large scale commercial installation.

As a further aspect of the present invention, a dirt or dust shield member 40 suitably constructed of non-conductive material is supported beneath the suspension member 24 and within the outline of the C-shaped hanger 28, in order to trap and collect any lubricants, dust or other foreign matter from the conveyor superstructure which may tend to fall onto the supported workpiece and thereby tend to contaminate the applied coating. It is this shield which makes element 28 a "sanitary hanger." In accordance with the inventive principles, the leading edge of the shield 40 is provided with a guide element 41 of a hard wearing, durable strip of brass or comparable material to enhance its strength and to accommodate repeated engagement with the hanger elements 28 for the purpose of maintaining them in their proper alignment for reliable and continuous contact with the spring loaded commutator elements 35. In this regard, it will be appreciated from FIG. 3 that the lateral extent of displacement or pressure on the leg 30 is limited on one side by the commutator 35 and on the other side by the leading edge of the safety shield 40.

It should be understood that the method and apparatus herein illustrated and described are intended to be representative only, as certain changes may be made therein without departing from the clear teachings of the disclosure. Accordingly, reference should be made to the following appended claims in determining the full scope of the invention.

I claim:

1. Apparatus for transporting workpieces along a predetermined path through a coating zone of uncharged coating particles, including a conveyor structure having a. a plurality of conductive work supporting elements adapted to support a workpiece and to convey said workpiece along said path;

b. isolating means adapted to provide a nonconductive barrier between selected ones of said supporting means and the remainder of said conveyor structure;

c. charging means adapted to apply a high electrical potential to said selected ones of said supporting means in said coating zone;

d. said charging means including contact means engageable with said support means and forming a progressive charging zone, a high voltage zone, and a discharging zone, e. said charging zone including a plurality of successively arranged charging contact elements engageable in sequence with work supporting elements being advanced by said conveyor structure, f. a high voltage charging source, g. a multiple step voltage divider system connected to said high voltage source and to said charging contact elements, whereby successive such elements are charged at progressively higher voltages for progressive charging of a workpiece being conveyed along said charging zone, h. said high voltage zone comprising contact means connected to said high voltage charging source and adapted for charging a workpiece to a predetermined high voltage, i. said high voltage zone being located downstream of the progressive charging zone in the direction of movement of a workpiece carried by the conveyor structure, j. said discharge zone comprising discharge contact means for grounding workpieces upon exit thereof from said high voltage zone.

2. Conveyor appartus for workpieces to be coated by electrostatic deposition systems, said apparatus comprising a. a plurality of discrete electrically conductive support means uniformly separated at predetermined spacing;

b. transport means moving said support means along a predetermined conveyor path;

c. means electrically grounding said conveyor apparatus;

d. dielectric means electrically isolating said support means from said conveyor apparatus;

e. first electrical contact means carried by said support means, f. a plurality of independent second electrical contact means mounted alongside said conveyor path for engagement by said first contact means, g. said first and second contact means being so arranged and proportioned that said first contact means is at all times in contact with at least one of said second contact means, h. high voltage charging means for applying a high electrical potential to said support means through the cooperation of said first and second electrical contact means; and i. voltage divider means connected between said high voltage charging means and selected ones of said first contact means in a manner whereby progressively increasing electrical potential is applied to successive ones of said first contact means, j. the arrangement being such that a workpiece on one of said support means, as it traverses said conveyor path is progressively increased from a ground potential to a predetermined maximum charge, is thereafter maintained at said maximum charge for a predetermined interval, and is finally reduced from said maximum level to ground potential.

3. The apparatus of claim 1, further including a. a spray means maintained at ground potential and adapted to issue uncharged spray particles therefrom.

4. The appartus of claim 2, further including a. voltage divider circuit means connected to selected others of said first contact means operative to effect final reduction of charge from maximum level to ground potential gradually in a series of steps.

* * * * *